US005708678A

United States Patent [19]

Fasoli et al.

[11] Patent Number: 5,708,678

[45] Date of Patent: Jan. 13, 1998

[54] METHOD TO EQUALIZE THE TEMPERATURE IN A HEATING FURNACE WITH A CONTROLLED-OXIDIZATION AMBIENT AND HEATING FURNACE CARRYING OUT THE METHOD

[75] Inventors: Fabio Fasoli, Acquasparta; Roberto Millone, Genova, both of Italy

[73] Assignee: Danieli & C. Officine Meccaniche SpA, Buttrio, Italy

[21] Appl. No.: 711,900

[22] Filed: Sep. 12, 1996

[30] Foreign Application Priority Data

Sep. 13, 1995 [IT] Italy ..... UD95A0175

[51] Int. Cl.[6] ..... F27D 7/06; H05B 3/00

[52] U.S. Cl. ..... 373/110; 373/18; 29/527.7; 72/201

[58] Field of Search ..... 373/109, 110, 373/115, 135, 136, 18; 72/201, 13, 202; 266/50; 29/527.7; 432/11

[56] References Cited

U.S. PATENT DOCUMENTS

| | | | |
|---|---|---|---|
| 4,261,552 | 4/1981 | Kameyama et al. | 266/50 |
| 4,338,077 | 7/1982 | Shibayama et al. | 432/11 |
| 4,629,417 | 12/1986 | Patalon | 432/5 |
| 4,898,628 | 2/1990 | Block et al. . | |
| 5,235,840 | 8/1993 | Blazevic | 72/201 |
| 5,479,808 | 1/1996 | Bricmont | 72/202 |
| 5,490,315 | 2/1996 | Kostopolos et al. | 29/527.7 |
| 5,528,816 | 6/1996 | Donini et al. | 29/527.7 |

FOREIGN PATENT DOCUMENTS 1559355 3/1969 France .

OTHER PUBLICATIONS

Database WPI Derwnt Publications Ltd., AN84079250 XP002001801 & JP-A-820-141 368 (Dumitomo Metal) 13 Aug. 1981 abstract.

Patent Abstracts of Japan, vol. 008, No. 106 (C-223), 18 May 84 & JP-A-59 020453 (Kawasaki Seitetsu KK), 2 Feb. 1984 abstract.

*Primary Examiner*—Tu B. Hoang

*Attorney, Agent, or Firm*—Antonelli, Terry, Stout, & Kraus, LLP

[57] ABSTRACT

Method to equalize the temperature in a heating furnace (10) with a controlled-oxidization ambient, the furnace (10) comprising at least one insulated chamber (11) cooperating with a supporting and conveying surface defined by a plurality of rollers (12), the rollers (12) including rings (35) to bear slabs (19), a plurality of burners (18) being comprised in cooperation with the upper part of the furnace (10), whereas a plurality of aspiration intakes (21) is included in cooperation with the lower part of the furnace (10), the feed to the burners (18) being adjusted in such a way as to ensure a strongly oxidizing atmosphere within the furnace (10) so as to obtain a desired and controllable layer of scale on the surface of a slab (19) in the furnace (10), this strongly oxidizing atmosphere being conveyed so as to surround and lap continuously and evenly the whole periphery of the slab (19), the furnace (10) cooperating downstream with a descaling assembly (22) to remove the layer of scale thus formed.

Heating furnace (10) with a controlled-oxidisation ambient, which comprises at least one insulated chamber (11) cooperating with a supporting and conveying surface defined by a plurality of rollers (12), the rollers (12) including rings (35) to support slabs (19), a plurality of burners (18) being included in cooperation with the upper part of the inside of the furnace (10), whereas a plurality of aspiration intakes (21) cooperates with the lower part of the inside of the furnace (10), the furnace (10) comprising a plurality of diversion baffles (20) to convey and direct fumes and gases, the baffles (20) being positioned in cooperation with the burners (18) and extending vertically to a position close to the upper surface of the slab (19), the burners (18) being fed in such a manner as to create a strongly oxidizing atmosphere within the furnace (10).

12 Claims, 3 Drawing Sheets

METHOD TO EQUALIZE THE TEMPERATURE IN A HEATING FURNACE WITH A CONTROLLED-OXIDIZATION AMBIENT AND HEATING FURNACE CARRYING OUT THE METHOD

This invention concerns a method to equalize the temperature in a heating furnace with a controlled-oxidization ambient, as set forth in the relative main claim.

The invention concerns also the heating furnace which carries out the method.

This invention is applied to a line for the rolling of slabs, particularly thin slabs, in cooperation with furnaces performing heating, temperature-maintaining and/or temperature-equalization which are arranged in an intermediate position between the casting machine and the rolling train.

The state of the art of rolling lines covers the requirement of arranging furnaces performing heating, temperature-equalization and/or temperature-equalisation between the continuous casting machines and the rolling train.

These furnaces have the purpose of preventing reductions of temperature of the product being fed at low casting speeds and of preparing that product for the rolling process carried out downstream.

To be more exact, these furnaces perform a primary task of maintaining the temperature at a high value and of equalizing the temperature at the core and at the surface of the product.

These furnaces normally cooperate upstream with a shears, if it is included.

These heating furnaces are normally equipped with a plurality of burners evenly spread along the length of the furnace and normally positioned on the sidewalls in a high position, and are also equipped with an advantageously mating plurality of intakes or aspiration outlets to discharge the fumes.

In the state of the art the burners are generally made to work so as to ensure a neutral, or even partly reducing, atmosphere within the furnace.

This situation is brought about intentionally to prevent the formation by oxidization of scale of a needle-shaped type on the surface of the slab, this scale being fixed in depth and thereafter very hard to remove in the downstream operations.

For this reason important oxidisation reactions do not take place in the furnace, and the layer of scale thus formed consists mainly of molecules of FeO, which are very resistant and hard to remove from the surface of the slab.

In such cases it is often necessary to have recourse to descaling means of a mechanical type inasmuch as the descaling means working with water are unable to remove effectively the whole layer of scale which the slab includes at the outlet of the heating furnace.

Moreover, the fumes and gases which have to lap the product being fed so as to ensure the heating of the product and the equalization of its temperature tend to be kept in a high position far from the product, particularly in the zones between one aspiration outlet and the adjacent one.

This situation has the effect that the heat generated by the burners is not transferred effectively and evenly onto the product to be heated, and the result, in particular, is that the upper surface of the product within the heating furnace undergoes a more intense action than its lower surface.

Furthermore, this discontinuous and uneven action of the fumes on the product to be heated does not enable controllable and constant reactions to be achieved on the surface of the product, with the result that the scale which forms does not have constant and homogeneous technological characteristics.

Besides, in view of the great length of the furnaces, which may be 80 meters or more, the firmation of the layer of scale is uncontrollable and uneven, thus leading to difficulties in the removal of the scale and very different results on the different surfaces of the cast product.

Another shortcoming often encountered in this type of heating furnaces is linked to the fact that on the periphery of the rings which are associated with the feeding rollers and which support the product to be fed, a layer of scale is formed which in the long term may also cause cuts and hollows in the surface of the product.

These cuts and hollows are retained in the product during the subsequent processing steps and lead to a resulting deterioration of quality which is not acceptable in the end-product.

The present applicants have designed, tested and embodied this invention to overcome these shortcomings of the state of the art and to obviate problems which have been the subject of complaints for a long time now by operators in this field and also to achieve further advantages.

This invention is set forth and characterised in the respective main claims, while the dependent claims describe variants of the idea of the main embodiment.

The purpose of the invention is to carry out within a heating and/or temperature-maintaining furnace a temperature-equalization method in a strongly oxidising ambient such as will permit the formation, on the surface of the slab, of a layer of scale required both in terms of thickness and in terms of chemical composition, the scale therefore being more readily removable by means of an action carried out downstream.

Another purpose of the invention is to make possible the achieving of temperature and technological conditions which are substantially uniform over the whole surface of the product to be heated and/or to have its temperature maintained.

Another purpose of the invention is to embody a heating furnace which enables the above thermal and technological conditions to be achieved and which enables excellent working conditions to be obtained for the supporting rollers.

The heating and temperature-maintaining furnace according to the invention is located preferably in a casting line which provides downstream of the continuous casting machine a controlled pre-rolling process performed immediately below the outlet of the mould.

This furnace comprises conventionally a plurality of burners, which are advantageously evenly distributed along the length of the furnace and have their relative outlet positioned on the sidewalls of the furnace in a high position.

According to the invention the burners are caused to function in such a way as to produce within the furnace a controlled and strongly oxidizing atmosphere suitable to obtain on the surface of the slab a required conversion of the FeO molecules into $Fe_2O_3$ molecules.

This conversion together with the control of the temperature parameters within the furnace, the temperatures being correlated with the type of metal being processed, makes it possible to have at the outlet of the furnace a desired and controllable layer of scale having technological characteristics such as will ensure a complete removal of the scale even when the conventional descaling systems using water are employed.

Moreover, so as to ensure a constant and uniform treatment of all the surfaces of the slab within the furnace, separation baffles are included in an intermediate position between two adjacent burners and extend vertically to a position close to the product to be heated within the furnace.

These baffles in cooperation with the underlying aspiration intakes perform a task of directing and conveying the fumes and gases emitted by the burners so as to compel those fumes and gases to lap in a more effective and even manner the product to be heated.

Furthermore, the action of these baffles causes the fumes and gases to surround the product fully and to lap all the surfaces of the product in a substantially uniform manner; this situation causes a double working and technological advantage.

The first advantage is achieved in terms of equalization of the temperature over the whole surface of the product.

The second advantage is achieved in terms of causing uniformity both as regards the thickness and also the chemical composition of the layer of scale which becomes formed on the surface of the product.

The oxidization reactions over the whole surface of the slab and therefore the desired conversion into $Fe_2O_3$ are thus enhanced and made uniform.

According to the invention a further advantage is achieved by dividing the heating furnace into two or more units between which a descaling assembly is placed.

It is known that the formation of scale in terms of thickness is greater in the first segment of the furnace and is then stabilized, or at least grows less quickly, in the successive segment.

According to the invention a descaling assembly is arranged substantially in the zone in which the growth of the thickness of the scale becomes slower, and is placed between two separate units of the heating furnace and removes the formed layer of scale, thus bringing the surface of the product back to a condition of substantial absence of scale.

According to the invention three or even more descaling assemblies may be included and be associated with as many separate units of the heating furnace along a conventional length of about 80 meters.

This embodiment enables the growth of the scale to be kept under control in a very accurate manner in terms both of thickness and of chemical composition, at the same time carrying out and accentuating the oxidization process within the furnace and thus making more effective and easier the operations of removal of the scale at the outlet of the furnace.

According to the invention a means is included in cooperation with a funnel-shaped outlet used for discharge of the scale, this outlet being placed below the supporting rollers feeding the product, and removes the scale from the periphery of the rings which support the product to be heated and which are associated with the supporting rollers.

According to the invention this means comprises milling or grinding means which are associated with movable arms that enable the milling or grinding means to be positioned in cooperation with the supporting rings.

The attached figures are given as a non-restrictive example and show a preferred embodiment of the invention as follows.

Figures 1, 2:
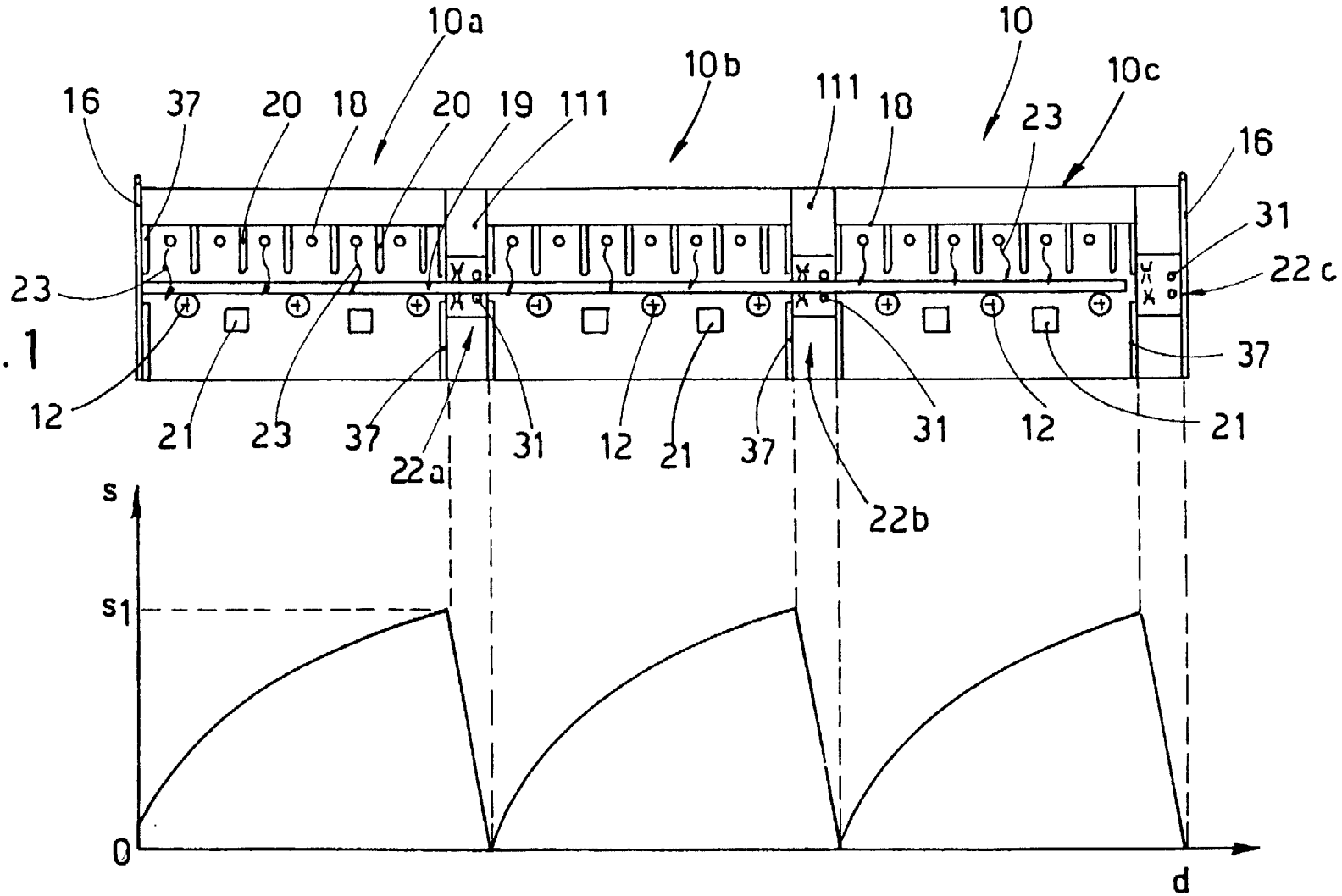
FIG. 1 shows a heating and/or temperature-maintaining furnace according to the invention.
FIG. 2 is a diagram of an example of the development of the thickness of the layer of scale along the furnace of FIG. 1.

A heating and/or temperature-maintaining furnace 10 shown in the attached figures comprises an insulated chamber 11 associated with a supporting and feeding surface defined by a plurality of rollers 12.

The rollers 12 include respective shafts 13 fitted in bearings 14 located outside the insulated chamber 11; these shafts 13 have one end associated with a drive means 15.

The furnace 10 includes at its ends doors 16 which can be opened, and cooperates on its lower side with a refractory base 17.

The furnace 10 comprises a plurality of burners 18, which are advantageously evenly distributed along the length of the furnace 10 and of which the outlets face towards the inside of the furnace 10.

The burners 18 are fed so as to emit fumes and gases having a composition which will create within the furnace 10 a strongly oxidizing atmosphere; this situation makes possible the starting and accentuating of conversion by oxidisation of the molecules of FeO into $Fe_2O_3$ so as to obtain on the surface of the slab 19 a desired and controlled layer of scale, which is not strong and can be readily removed.

Below the surface defined by the rollers 12 for supporting the slab 19 are included aspiration intakes 21, which have the purpose of aspirating downwards the heating fumes and gases referenced with 23 and emitted by the burners 18.

In this case, diversion means in the form of separation baffles 20 are included in cooperation with the burners 18 and with the aspiration intakes 21 and have the task of conveying the fumes and gases 23 so as to surround the slab 19, thus providing a uniform heating action over the whole surface of the slab 19.

This action of the fumes and gases 23 emitted by the burners 18 around the slab 19 makes more intense, effective and uniform the chemical oxidization conversion into molecules of $Fe_2O_3$, with the result that the growth of the layer of scale takes place in an even and controlled manner.

FIG. 1 shows in this case that the furnace 10 is structured in three separate units, 10*a*, 10*b* and 10*c* respectively positioned in sequence and connected by intermediate insulated chambers 111.

Each furnace unit 10*a*, 10*b* and 10*c* comprises at its inlet and at its outlet barriers 37, which reduce the outward dispersion of heat from the furnace 10.

According to a variant the furnace 10 is structured with two units, or else four units or more.

Between one furnace unit and the next one a descaling assembly 22 is placed in this case.

According to the invention the descaling assembly 22 has the task of removing the layer of scale which has formed in the first segment of the furnace 10, thus bringing the surface conditions of the slab 19 back to a condition substantially the same as that at the inlet of the furnace 10.

In the first segment within the furnace 10 the thickness of the scale grows progressively at a very high speed until it reaches a value S1 and is then stabilized or possibly grows at a much slower speed (see FIG. 2).

In this case a first descaling assembly 22*a* is included downstream of the first unit 10*a* of the furnace, substantially at the point where the value S1 is reached, and removes completely the layer of scale.

The product is then fed into the second unit 10*b* of the furnace, and the layer of scale grows again up to the thickness S1 and is then removed by a second descaling assembly 22*b*.

Lastly, there is in this case a third unit 10c of the furnace 10, which in turn is followed by a third descaling assembly 22c.

This embodiment makes possible a very precise and accurate control of the formation of the layer of scale on the surface of the slab 19 and also a controlled adjustment of the oxidization reactions, which enable a scale to be obtained which can be removed more easily from the surface of the slab 19.

According to the invention an assembly 31 suitable to measure the thickness of the remaining layer of scale after the removal operation may be included in cooperation with, and downstream of, each of the descaling assemblies 22.

According to a variant an assembly 31 (not shown here) to measure the thickness of the layer of scale may also be included immediately upstream of each descaling assembly 22.

According to the invention these assemblies 31 to measure the layer of scale may be connected by means of an actuation and control unit to the burners 18 so as to alter the working and feeding parameters of the burners 18 according to the detecting of an incorrect layer of scale.

In this example collection intakes 24 shaped as funnels are positioned below the rollers 12 and have the purpose of collecting and conveying the scale and other impurities released from the surface of the slab 19 and from the surface of the rollers 12 during the heat treatment carried out within the furnace 10.

According to the invention a removal means 25 is included in cooperation with the collection intakes 24 and is suitable to remove the scale that is generated on the surface of rings 35 which are associated with the surface of the rollers 12 and which have the task of supporting the slab 19.

In this case the removal means 25 comprises a trolley 26 able to run on wheels 27 and associated with a base plate 28.

The trolley 26 can be moved longitudinally on the base plate 28 along the space left available by the dimensions of the collection intakes 24.

A telescopically extensible arm 30 is fitted on the trolley 26 and bears scale removal means, which in this case consist of circular grinding wheels 32.

In this example a pair of circular grinding wheels 32 are included and are located opposite to each other on each side of the arm 30.

The trolley 26 can also be traversed transversely to the furnace 10 in the directions shown with the arrows 34 so as to bring the circular grinding wheels 32 into cooperation with all the rings 35 fitted to one single roller 12.

Figure 3:
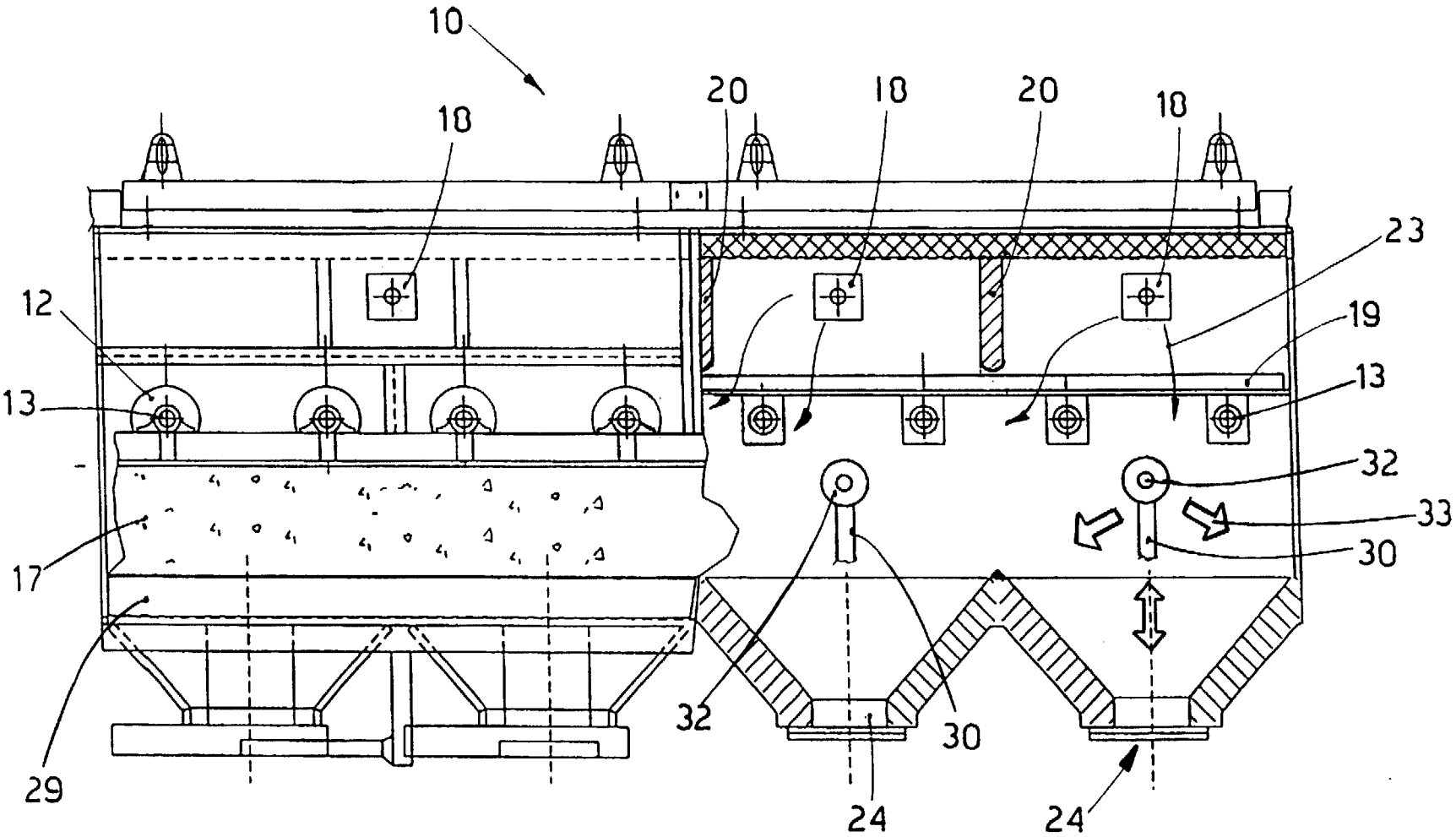
FIG. 3 shows in detail a possible longitudinal section of a heating furnace of the type of FIG. 1.
Figure 4:
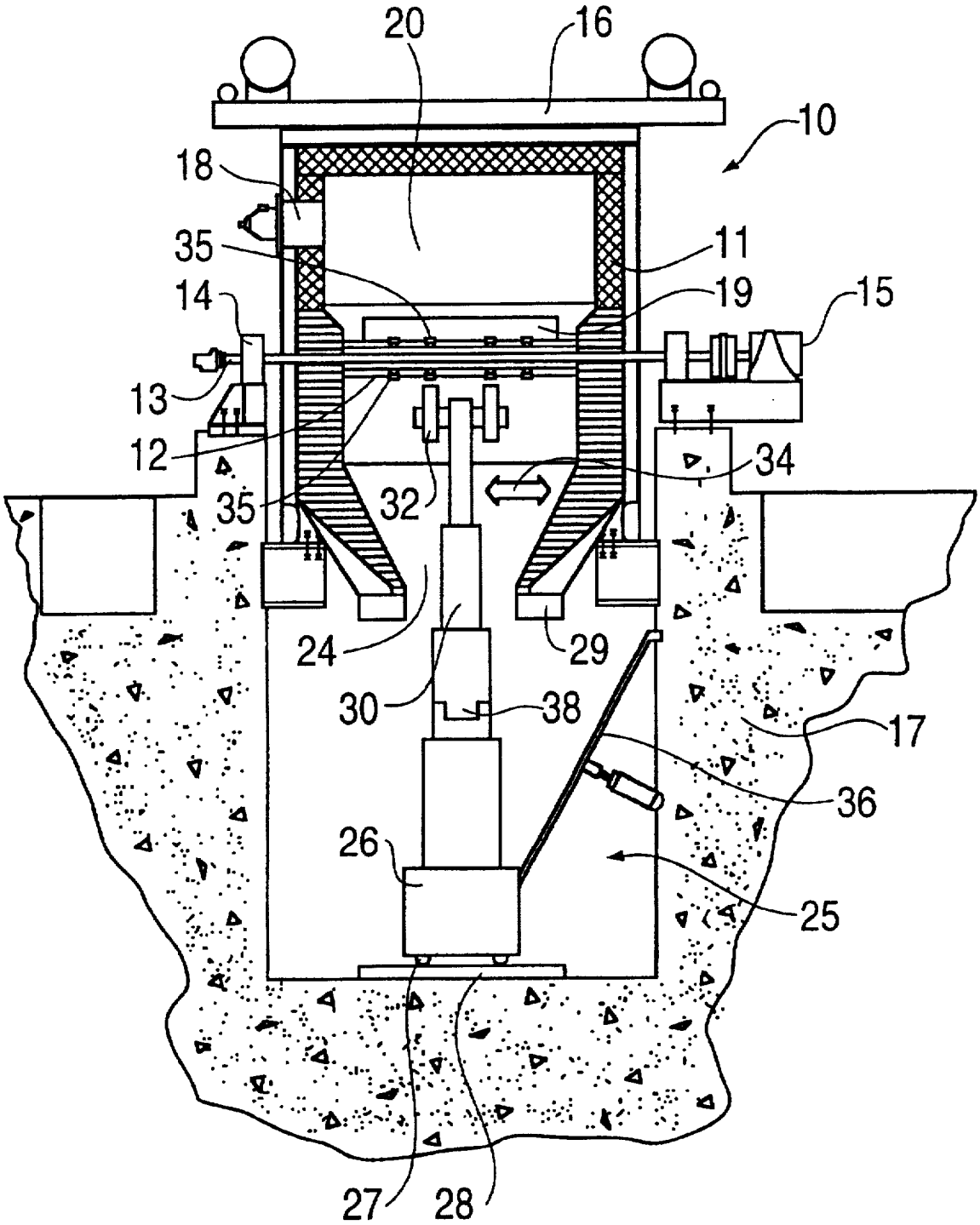
FIG. 4 shows a possible cross-section of a heating furnace of the type of FIG. 1, in which can be seen the means for removal of the scale from the supporting rings associated with the rollers.

Since in this case each removal means 25 tends a pair of rollers 12, the arm 30 can be caused to oscillate in the longitudinal direction 33 (FIG. 3) on an articulated joint 38 so as to tend both the rollers 12 of the pair of rollers.

The arm 30 in its retracted position is withdrawn from the collection intake 24 and enables that intake 24 to be closed by slide valve means 29.

A positionable protective screen 36 is included advantageously in cooperation with the removal means 25.

We claim:

1. Method to equalize the temperature in a heating furnace with a controlled-oxidization ambient, comprising steps of: conveying a slab into a furnace comprising at least one insulated chamber, the slab being conveyed by a supporting and conveying surface defined by a plurality of rollers, the rollers including rings to bear the slab, a plurality of burners being comprised in cooperation with an upper part of the inside of the furnace and a plurality of aspiration intakes being included in cooperation with a lower part of the furnace; adjusting feeding material to the burners in such a way as to ensure an oxidizing atmosphere within the furnace so as to obtain a desired and controllable layer of scale on the surface of the slab in the furnace, this oxidizing atmosphere being conveyed so as to surround and lap continuously and evenly the whole periphery of the slab; conveying the slab to a descaling assembly downstream of the furnace; and removing the layer of scale formed on the slab in the furnace.

2. Method as in claim 1, in which the layer of scale is controlled in terms of thickness and of chemical composition by acting on a composition of fumes and gases emitted by the burners.

3. Method as in claim 1, in which the fumes and gases emitted by the burners are conveyed in cooperation with the whole periphery of the slab by diversion baffles positioned in cooperation with the burners and extending vertically at a position close to the upper surface of the slab.

4. Method as in claim 1, in which at least one step of removing of the layer of scale is included at an intermediate position in the furnace.

5. Method as in claim 4, in which a step of measurement of the thickness of the layer of scale on the surface of the slab (19) is included at least downstream of the step of removal of the layer of scale.

6. Method as in claim 5, further comprising governing adjustment and correction of working parameters of the burners so as to control a strength of the oxidizing atmosphere in response to the thickness of the layer of scale measured.

7. Method as in claim 1, further comprising at least one step of removing scale from a surface of the rings associated with the rollers.

8. Heating furnace with a controlled-oxidization ambient, which comprises: at least one insulated chamber; a supporting and conveying surface defined by a plurality of rollers within the at least one insulated chamber, the rollers including rings to support a slab; a plurality of burners being included in cooperation with an upper part of an inside of the at least one chamber; a plurality of aspiration intakes cooperating with a lower part of the inside of the at least one insulated chamber; a plurality of diversion baffles to convey and direct fumes and gases, the baffles being positioned in cooperation with the burners and extending vertically to a position close to the upper surface of the slab supported on the supporting and conveying surface, the burners being fed in such a manner as to create an oxidizing atmosphere within the furnace.

9. Heating furnace as in claim 8, which is structured with at least two units, between adjacent pairs of which is placed a scale removing assembly to remove a layer of scale from the slab.

10. Heating furnace as in claim 9, in which, between adjacent pairs of the at least two units is provided an assembly to measure a thickness of the layer of scale in cooperation with, and at least downstream of, the scale removing assembly.

11. Heating furnace, as in claim 9, further comprising scale removal means to remove the scale from the surface of the rings supporting the slabs, and funnel-shaped intakes receiving discharged scale, the funnel-shaped intakes being located below the rollers.

12. Heating furnace as in claim 11, in which one scale removal means is provided for at least two rollers.

* * * * *